US010468813B2

(12) United States Patent
Zhang et al.

(10) Patent No.: US 10,468,813 B2
(45) Date of Patent: Nov. 5, 2019

(54) CONNECTOR FOR CONNECTING WIRE AND CONNECTOR ASSEMBLY

(71) Applicant: Tyco Electronics (Shanghai) Co. Ltd., Shanghai (CN)

(72) Inventors: Wei Zhang, Shanghai (CN); Ming Shi, Shanghai (CN); Xiang Xu, Shanghai (CN); Xiaozhi Fu, Shanghai (CN); Cui Li, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/704,408

(22) Filed: Sep. 14, 2017

(65) Prior Publication Data

US 2018/0076562 A1 Mar. 15, 2018

(30) Foreign Application Priority Data

Sep. 14, 2016 (CN) ..... 2016 2 1057297 U

(51) Int. Cl.

| | |
|---|---|
| ***H01R 13/52*** | (2006.01) |
| ***H01R 13/11*** | (2006.01) |
| ***H01R 13/415*** | (2006.01) |
| ***H01R 13/627*** | (2006.01) |
| ***H01R 24/20*** | (2011.01) |
| *H01R 103/00* | (2006.01) |

(52) U.S. Cl.

CPC ..... *H01R 13/5208* (2013.01); *H01R 13/112* (2013.01); *H01R 13/415* (2013.01); *H01R 13/6272* (2013.01); *H01R 24/20* (2013.01); *H01R 13/5219* (2013.01); *H01R 2103/00* (2013.01)

(58) Field of Classification Search

CPC .. H01R 13/415; H01R 13/53; H01R 13/5205; H01R 13/5208; H01R 13/112; H01R 24/20; H01R 13/6272; G08B 17/113

USPC ..... 439/519

See application file for complete search history.

(56) References Cited

U.S. PATENT DOCUMENTS

| | | | | |
|---|---|---|---|---|
| 4,605,272 A * | 8/1986 | Myers | H01R 13/53 | 439/274 |
| 4,973,266 A * | 11/1990 | Bullard | H01R 13/52 | 439/589 |
| 4,983,344 A * | 1/1991 | Brown | B29C 45/1635 | 264/255 |
| 4,986,764 A * | 1/1991 | Eaby | H01R 13/53 | 439/275 |
| 5,351,973 A * | 10/1994 | Taniuchi | H01R 13/5205 | 277/616 |

(Continued)

*Primary Examiner* — Jean F Duverne

(74) *Attorney, Agent, or Firm* — Barley Snyder

(57) ABSTRACT

A connector for connecting a wire comprises a housing, a conductive terminal, and sealing member. The housing has a receiving passage extending through the housing in an insertion direction in which the wire is inserted into the housing. The receiving passage has an insertion port disposed at an end of the receiving passage in the insertion direction. The conductive terminal is disposed in the receiving passage and electrically connects the wire to a mating conductive terminal of a mating connector. The sealing member is disposed adjacent the insertion port and has a wire receiving passageway though which the wire extends. The sealing member seals the receiving passage at the insertion port.

19 Claims, 6 Drawing Sheets

(56) References Cited

U.S. PATENT DOCUMENTS

| | | | | | |
|---|---|---|---|---|---|
| 5,580,266 | A * | 12/1996 | Shelly | H01R 13/53 | 439/281 |
| 5,626,486 | A * | 5/1997 | Shelly | H01R 13/53 | 439/273 |
| 6,039,603 | A * | 3/2000 | Wakata | H01R 13/5205 | 439/587 |
| 6,336,821 | B1 * | 1/2002 | Hattori | H01R 13/17 | 439/282 |
| 6,641,421 | B1 * | 11/2003 | Leavitt | H01R 13/53 | 439/271 |
| 7,114,991 | B2 * | 10/2006 | Shiga | H01R 13/5208 | 439/587 |
| 7,273,395 | B2 * | 9/2007 | Hayashi | H01R 13/506 | 439/587 |
| 7,762,842 | B2 * | 7/2010 | Deubel | H01R 13/5208 | 439/589 |
| 8,241,061 | B2 * | 8/2012 | Chazottes | H01R 13/5213 | 439/272 |
| 8,337,240 | B2 * | 12/2012 | Feldmeier | H01R 13/04 | 439/488 |
| 9,478,882 | B1 * | 10/2016 | Schmidt | G08B 17/113 | |

* cited by examiner

CONNECTOR FOR CONNECTING WIRE AND CONNECTOR ASSEMBLY

CROSS-REFERENCE TO RELATED APPLICATION

This application claims the benefit of the filing date under 35 U.S.C. § 119(a)-(d) of Chinese Patent Application No. 201621057297.6, filed on Sep. 14, 2016.

FIELD OF THE INVENTION

The present invention relates to a connector and, more particularly, to a connector connecting to a wire.

BACKGROUND

To electrically connect two cables, as is known in the art, each cable is connected to a plug connector or a receptacle connector. A mating of the plug connector and the receptacle connector forms the electrical connection between the cables. Each connector generally includes an insulative housing and a plurality of conductive connection terminals disposed in the insulative housing. To connect the cable to the plug or receptacle connector, a portion of an insulation layer of the cable is stripped to expose a wire, and the wire is inserted into and electrically connected to the conductive terminal in the housing. The electrical connection between the two cables is achieved by connecting the conductive terminals.

In connectors according to the prior art, the wire is inserted into the housing through an insertion port at an end of the housing. When using the connector in a moist environment, foreign matter, such as moisture, often enters the housing through the insertion port due to the difficulty in sealing the wire at the insertion port, negatively impacting the electrical performance of the connector.

SUMMARY

A connector according to the invention for connecting a wire comprises a housing, a conductive terminal, and sealing member. The housing has a receiving passage extending through the housing in an insertion direction in which the wire is inserted into the housing. The receiving passage has an insertion port disposed at an end of the receiving passage in the insertion direction. The conductive terminal is disposed in the receiving passage and electrically connects the wire to a mating conductive terminal of a mating connector. The sealing member is disposed adjacent the insertion port and has a wire receiving passageway though which the wire extends. The sealing member seals the receiving passage at the insertion port.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
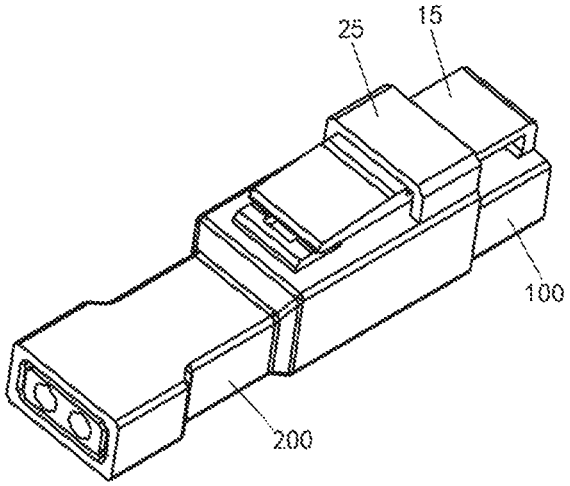
FIG. 1 is a perspective view of a connector assembly according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
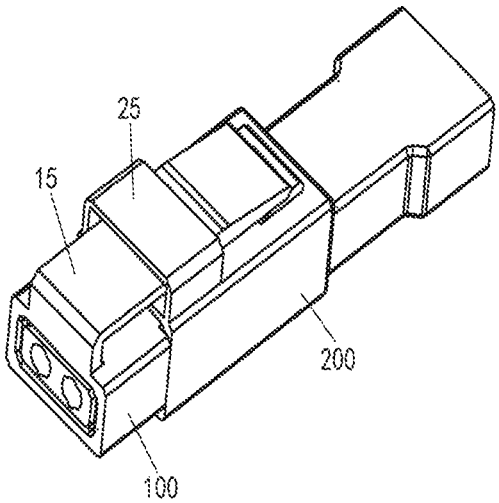
FIG. 2 is another perspective view of the connector assembly.
Figure 3:
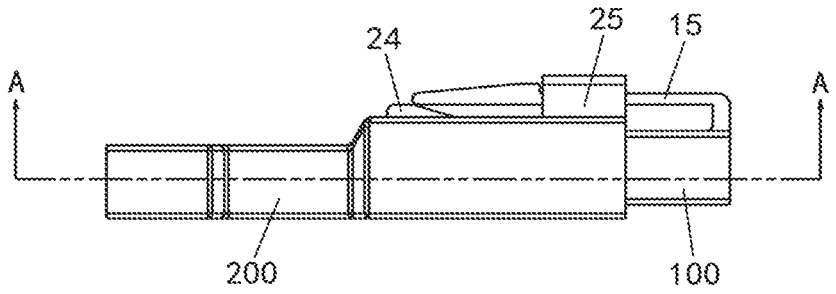
FIG. 3 is a side view of the connector assembly.
Figure 4:
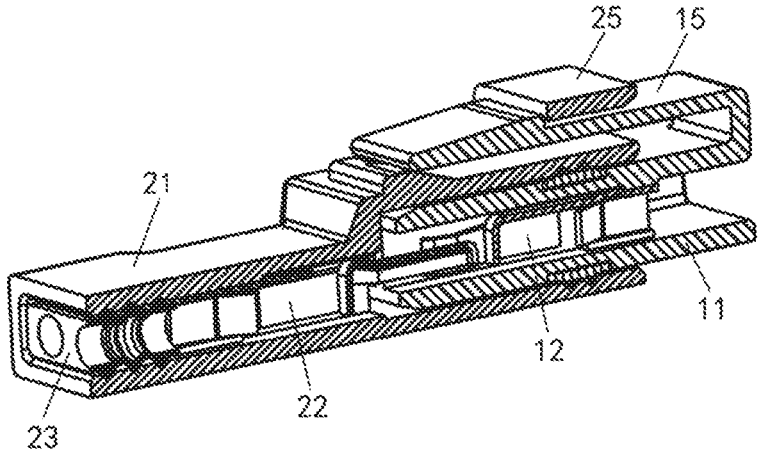
FIG. 4 is a sectional perspective view of the connector assembly.
Figure 7:
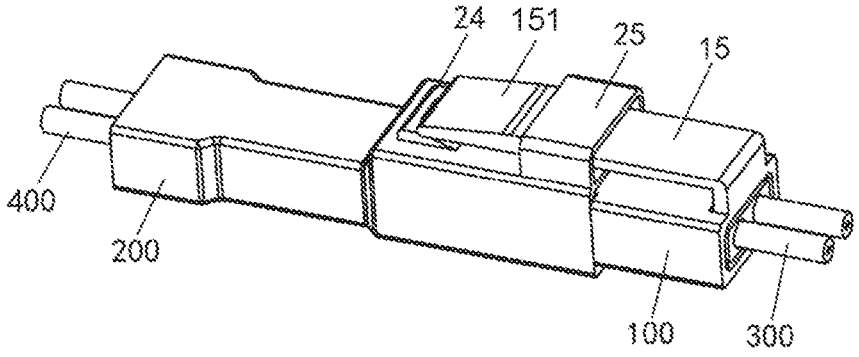
FIG. 7 is another perspective view of the connector assembly.

A connector assembly according to the invention is shown generally in FIGS. 1, 2, and 7. The connector assembly comprises a plug connector 100 connected to a plurality of first wires 300 and a receptacle connector 200 mating with the plug connector 100 connected to a plurality of second wires 400. When the plug connector 100 is mated with the receptacle connector 200, the plurality of first wires 300 and the plurality of second wires 400 are electrically connected with each other. Throughout the specification, either the plug connector 100 or the receptacle connector 200 may be referred to as a connector and the other referred to as a mating connector.

Figure 8:
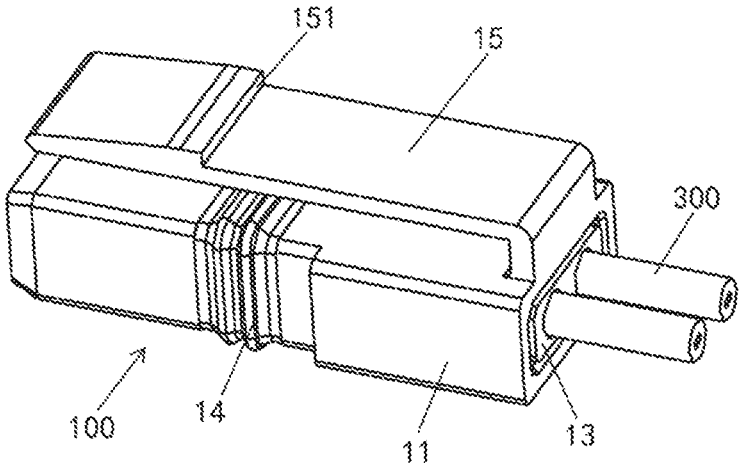
FIG. 8 is a perspective view of a plug connector of the connector assembly.
Figure 9:
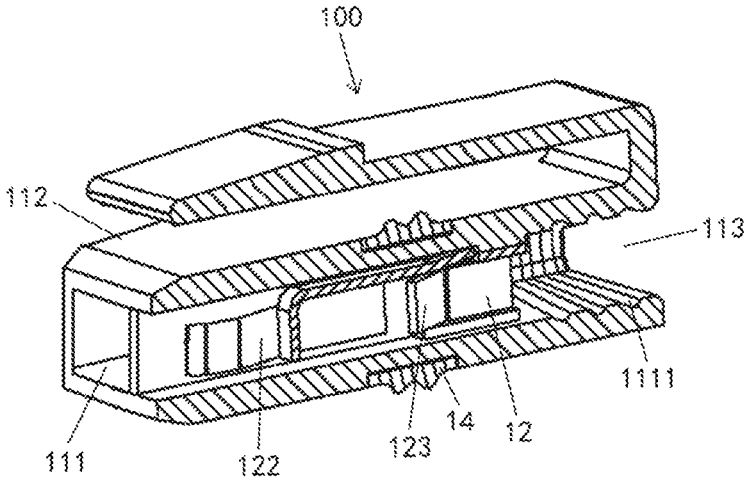
FIG. 9 is a sectional perspective view of the plug connector.
Figure 10:
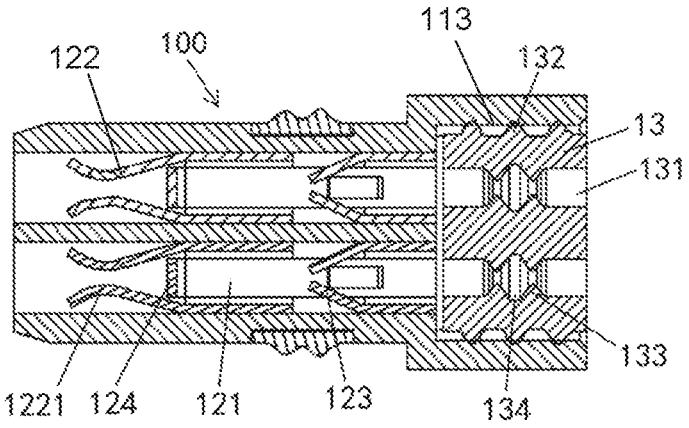
FIG. 10 is a sectional top view of the plug connector.

The plug connector 100 is shown in FIGS. 8-10. The plug connector 100 includes a first housing 11, a pair of first conductive terminals 12, and a sealing member 13.

The first housing 11 is made of an insulative material such as plastic and, as shown in FIGS. 9 and 10, has a pair of first receiving passages 111 extending through the first housing 11 in an insertion direction of the first wire 300 and a plug portion 112. Each first receiving passage 111 has a first insertion port 113 disposed at an end of the first receiving passage 111 in the insertion direction.

The plug portion 112, as shown in FIGS. 7-9, has a cantilevered arm 15 extending in the insertion direction of the first wire 300 outside of the first housing 11. The cantilevered arm 15 is integrally connected with the first housing 11 and has an L-shape. A latch 151 is disposed on an outer side of the cantilevered arm 15. A second sealing member 14, as shown in FIGS. 8 and 9, is disposed around an outer surface of the plug portion 112.

The first sealing member 13 is made of a material such as rubber and, as shown in FIG. 10, is mounted at a position adjacent the first insertion port 113; in the shown embodiment, the first sealing member 13 is mounted in the first insertion port 113. The first wire 300 is inserted into the first receiving passage 111 through the first insertion port 113, and the first sealing member 13 has at least one wire receiving passageway 131 through which the first wire 300 passes. The first sealing member 13 forms a seal with the first wire 300 to prevent foreign moisture from entering the first receiving passage 111 through the first insertion port 113.

The first sealing member 13, as shown in FIG. 10, has at least one ring shaped protrusion 132 around an outer circumferential surface of the first sealing member 13, and correspondingly, the first receiving passage 111, as shown in FIG. 9, has at least one ring shaped groove 1111 around an inner circumferential surface of the first receiving passage 111. The protrusions 132 of the first sealing member 13 engage the grooves 1111 of the first receiving passage 111, sealing the first sealing member 13 and the first receiving passage 111. In an alternative embodiment, the first sealing member 13 has at least one ring shaped groove around an outer circumferential surface of the first sealing member 13, and correspondingly, the receiving passage 111 has at least one ring shaped protrusion around an inner circumferential surface of the receiving passage 111; the groove of the first sealing member 13 engaging the protrusion of the first receiving passage 111.

As shown in FIG. 10, at least two sealing rings 133 are disposed on an inner wall of the first wire receiving passageway 131 of the first sealing member 13 and project radially inwardly. A receiving groove 134 is disposed between the adjacent sealing rings 133. A minimum inner diameter of the sealing ring 133 is less than an outer diameter of the first wire 300, and a maximum inner diameter of the receiving groove 134 is greater than an outer diameter of the first wire 300. The sealing ring 133 maintains good sealing with the first wire 300 and foreign matter such as moisture entering through the outer sealing ring 133 accumulates in the receiving groove 134, preventing the moisture from further entering the first receiving passage 111.

The first conductive terminals 12, as shown in FIGS. 9 and 10, are received in the two first receiving passages 111 of the first housing 11, respectively. Each first conductive terminal 12 has a flat body 121, a contact portion 122, and a pair of crimps 123. The contact portion 122 extends from the body 121 and has a pair of clamping contact arms 1221 obliquely extending toward each other from the body 121. The pair of crimps 123 are disposed on the body 121 and crimp the first wire 300 inserted through the wire receiving passageway 131 of the first sealing member 13, so that the first wire 300 is electrically connected to the first conductive terminal 12. Each first conductive terminal 12 has a stop 124 formed on the body 121 at a position proximate to the contact portion 122. The stop 124 limits an insertion length of the first wire 300.

Figure 5:
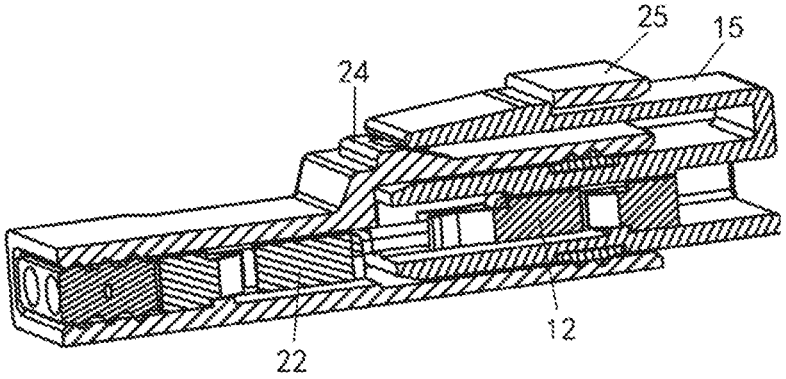
FIG. 5 is another sectional perspective view of the connector assembly.
Figure 6:
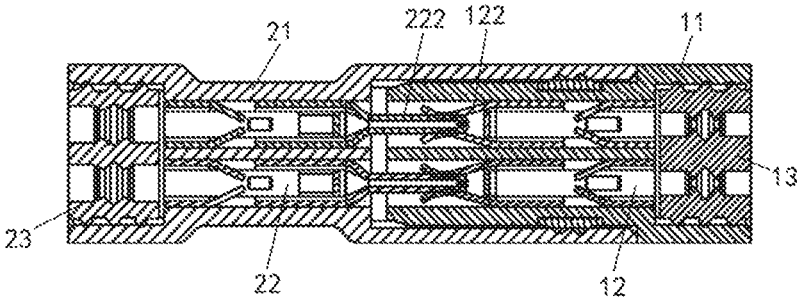
FIG. 6 is a sectional top view of the connector assembly.
Figure 11:
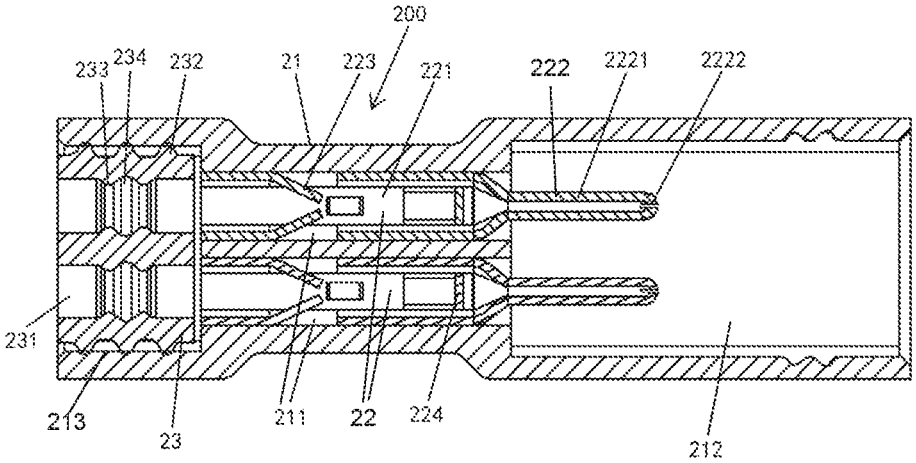
FIG. 11 is a sectional top view of a receptacle connector of the connector assembly.

The receptacle connector 200 is shown in FIGS. 5, 6, and 11. The receptacle connector 200 includes a second housing 21, a pair of second conductive terminals 22, and a third sealing member 23.

The second housing 21 is made of an insulative material such as plastic and, as shown in FIG. 11, has a pair of second receiving passages 211 extending through the second housing 21 in an insertion direction of the second wire 400 and a receptacle portion 212 receiving the plug portion 112 of the plug connector 100. Each second receiving passage 211 has a second insertion port 213 disposed at an end of the second receiving passage 211 in the insertion direction.

The third sealing member 23 is made of a material such as rubber and, as shown in FIG. 11, is mounted in the second insertion port 213 of the second receiving passage 211. The second wire 400 is inserted into the second receiving passage 211 through the second insertion port 213, and the third sealing member 23 has at least one wire receiving passageway 231 through which the second wire 400 passes. The third sealing member 23 forms a seal with the second wire 400 to prevent foreign moisture from entering the second receiving passage 211 through the second insertion port 213.

The third sealing member 23, as shown in FIG. 11, has at least one ring shaped protrusion 232 around an outer circumferential surface of the third sealing member 23, and correspondingly, the second receiving passage 211 has at least one ring shaped groove around an inner circumferential surface of the receiving passage 211. The protrusion 232 of the third sealing member 23 engages the groove of the second receiving passage 211, sealing the third sealing member 23 and the second receiving passage 211. At least two sealing rings 233 projecting radially inwardly are disposed on an inner wall of the wire receiving passageway 231. Receiving grooves 234 are disposed between the sealing rings 233. A minimum inner diameter of the sealing ring 233 is less than an outer diameter of the second wire 400, and the maximum inner diameter of the receiving groove 234 is larger than the outer diameter of the second wire 400. The sealing ring 233 maintains good sealing with the second wire 400 and foreign matter such as moisture entering through the outer sealing ring 233 accumulates in the receiving groove 234, preventing the moisture from further entering into the second receiving passage 211. In the shown embodiment, the first receiving passage 111 of the plug connector 100 has the same structure in the first insertion port 113 as that in the second insertion port 213 of the second receiving passage 211 of the receptacle connector 200. Similarly, the first sealing member 13 has the same structure as that of the third sealing member 23.

The two second conductive terminals 22, as shown in FIG. 11, are received in the two second receiving passages 211 of the second housing 21, respectively, to be electrically connected with the first conductive terminals 12 of the plug connector 100. Each of the second conductive terminals 22 has a flat body 221, a contact portion 222 and a pair of crimps 223. The contact portion 222 has a pair of clamped contact arms 2221 extending from the body 221 parallel to one another to be clamped between the clamping contact arms 1221 of the plug connector 100. Free ends 2222 of the clamped contact arms 2221 are bent inwardly towards to each other, so as to maintain a certain elasticity. The pair of crimps 223 are disposed on the body 221 to crimp the second wire 400 inserted through the wire receiving passageway 231 of the third sealing member 23, so that the second wire 400 is electrically connected to the second conductive terminal 22. Each of the second conductive terminals 22 has a stop 224 formed on the body 221 at a position proximate to the contact portion 222. The stop 224 limits an insertion length of the second wire 400.

As shown in FIGS. 5 and 7, a positioning frame 25 is disposed on the second housing 21. A protrusion 24 is disposed on a side of the positioning frame 25 spaced apart from the second insertion port 213 of the second receiving passage 211.

The plug connector 100 is matable with the receptacle connector 200 as shown in FIGS. 1-7. During mating of the plug connector 100 with the receptacle connector 200, the cantilevered arm 15 of the plug connector 100 passes through the positioning frame 25, and the latch 151 of the cantilevered arm 15 abuts against the positioning frame 25. An end of the cantilevered arm 15 abuts against the protrusion portion 24, preventing the latch 151 from being disengaged from the positioning frame 25. To separate the plug connector 100 from the receptacle connector 200, a portion of the cantilevered arm 15 between the positioning frame 25 and the protrusion portion 24 is pressed such that the cantilevered arm 15 is bent downwardly. The latch 151 of the cantilevered arm 15 then separated from the positioning frame 25, permitting removal of the plug connector 100 from the receptacle connector 200.

When the plug connector 100 is mated with the receptacle connector 200, as shown in FIG. 6, the contact arms 1221 of the contact portion 122 of the plug connector 100 crimp the contact arms 2221 of the contact portion 222 of the receptacle connector 200, forming and maintaining an electrical connection between the first conductive terminal 12 and the second conductive terminal 22. An electrical connection between the first conductive terminal 12 and the second conductive terminal 22 electrically connects the first wires 300 and the second wires 400. In an alternative embodiment, the contact portion 222 of the receptacle connector 200 has the crimping contact arms while the contact portion 122 of the plug connector 100 has the crimped contact arms.

Because the first sealing member 13 is disposed at the first insertion port 113 of the plug connector 100, an outer wall of the first wire 300 tightly engages with an inner wall of the first insertion port 113 to prevent foreign moisture from entering the first receiving passage 111 through the first insertion port 113. Further, because the third sealing member 23 is disposed at the second insertion port 213 of the receptacle connector 200, an outer wall of the second wire 400 tightly engages with an inner wall of the second insertion port 213 to prevent foreign moisture from entering the second receiving passage 211 through the second insertion port 213. Further, when the plug connector 100 is mated with the receptacle connector 200, the second sealing member 14 is squeezed between an outer wall of the plug portion 112 and an inner wall of the receptacle portion 212 to form a seal between the outer wall of the plug portion 112 and the inner wall of the receptacle portion 212. Moisture thus cannot enter the first receiving passage 111 and the second receiving passage 211 through the plug portion 112 of the plug connector 100 and the receptacle portion 212 of the receptacle connector 200. The first conductive terminal 12 in the first housing 11 and the second conductive terminal 22 in the second housing 21 are in an enclosed space where the foreign matter such as moisture cannot contact the first and second conductive terminals 12, 22, maintaining a good electrical connection between the first and second conductive terminals 12, 22.

In the shown embodiment, the plug connector 100 and receptacle connector 200 each have two receiving passages 111, 211 and two conductive terminals 12, 22 connecting to two wires 300, 400, respectively. In other embodiments, as would be understood by one with ordinary skill in the art, the number of receiving passages 111, 211, conductive terminals 12, 22, and wires 300, 400 may vary within the scope of the invention.

What is claimed is:

1. A connector for connecting a wire, comprising:

a housing having a first receiving passage extending through the housing in an insertion direction, the first receiving passage having an insertion port with a ring shaped groove disposed inside an end thereof and extending into and around an inner circumferential surface of the first receiving passage;

a conductive terminal disposed in the first receiving passage and electrically connecting a wire to a mating conductive terminal of a mating connector; and a first sealing member disposed inside the insertion port and extending to the end of the insertion port, the first sealing member having a ring shaped protrusion around an outer circumferential surface and a wire receiving passageway through which the wire extends, the wire receiving passageway having a receiving groove around an inner circumferential surface, the ring shaped protrusion engaging the ring shaped groove and the first sealing member sealing the first receiving passage at the insertion port.

2. The connector of claim 1, wherein an inner wall of the wire receiving passageway has a pair of sealing rings projecting radially inward and the receiving groove disposed between the sealing rings.

3. The connector of claim 2, wherein a minimum inner diameter of the sealing rings is less than an outer diameter of the wire and a maximum inner diameter of the receiving groove is greater than the outer diameter of the wire.

4. The connector of claim 1, wherein the conductive terminal has:

a flat body;

a contact portion extending from the body and electrically connected with the mating conductive terminal; and a pair of crimps disposed on the body crimping the wire.

5. The connector of claim 4, wherein the conductive terminal has a stop disposed on the body and limiting an insertion length of the wire.

6. The connector of claim 4, wherein the contact portion has a pair of contact arms extending obliquely toward each other from the body and clamping a contact portion of the mating conductive terminal.

7. The connector of claim 4, wherein the contact portion has a pair of contact arms extending parallel to one another from the body and clamped between a contact portion of the mating conductive terminal.

8. The connector of claim 7, wherein a free end of each of the contact arms is bent inwardly.

9. The connector of claim 1, wherein the connector is a plug connector and the housing has a plug portion adapted to be inserted into a receptacle portion of the mating connector.

10. The connector of claim 9, wherein the connector has a second sealing member disposed around an outer surface of the plug portion.

11. The connector of claim 10, wherein the plug portion has a cantilevered arm extending in the insertion direction outside of the housing and a latch disposed on an outer side of the cantilevered arm.

12. The connector of claim 1, wherein the connector is a receptacle connector and the housing has a receptacle portion adapted to receive a plug portion of the mating connector.

13. The connector of claim 12, wherein the housing has a positioning frame permitting a cantilevered arm of the mating connector to pass therethrough and abutting a latch of the cantilevered arm.

14. The connector of claim 13, wherein the positioning frame has a protrusion disposed on a side of the positioning frame spaced apart from the insertion port and supporting an end of the cantilevered arm.

15. A connector assembly, comprising:

a plug connector including:

a first housing having plug portion and a first receiving passage extending through the first housing in a first insertion direction in which a first wire is inserted into the first housing, the first receiving passage having a first insertion port disposed at an end of the first receiving passage in the first insertion direction;

a first conductive terminal disposed in the first receiving passage; and a first sealing member disposed adjacent the first insertion port and having a first wire receiving passageway through which the first wire extends, the first sealing member sealing the first receiving passage at the first insertion port; and a receptacle connector including:

a second housing having receptacle portion adapted to receive the plug portion and a second receiving passage extending through the second housing in a second insertion direction in which a second wire is inserted into the second housing, the second receiving passage having a second insertion port disposed at an end of the second receiving passage in the second insertion direction;

a second conductive terminal disposed in the second receiving passage and electrically connected with the first conductive terminal; and a third sealing member disposed adjacent the second insertion port and having a second wire receiving passageway though which the second wire extends, the third sealing member sealing the second receiving passage at the second insertion port.

16. The connector assembly of claim 15, wherein the plug connector has a second sealing member disposed around an outer surface of the plug portion and sealing an outer wall of the plug portion and an inner wall of the receptacle portion.

17. The connector assembly of claim 15, wherein the plug portion has a cantilevered arm extending in the first insertion direction on an outer surface of the first housing and a latch disposed on an outer side of the cantilevered arm, and the receptacle portion has a positioning frame disposed on the second housing and permitting a cantilevered arm of the mating connector to pass therethrough, the latch of the cantilevered arm abutting the positioning frame and preventing disengagement of the cantilevered arm from the positioning frame.

18. The connector assembly of claim 17, wherein the positioning frame has a protrusion disposed on a side of the positioning frame spaced apart from the second insertion port and supporting an end of the cantilevered arm.

19. The connector assembly of claim 15, wherein the first conductive terminal has:

a flat first body;

a first contact portion extending from the first body; and a pair of first crimps disposed on the first body crimping the first wire; and the second conductive terminal has:

a flat second body;

a second contact portion extending from the second body and electrically connected with the first contact portion; and a pair of second crimps disposed on the second body crimping the second wire.

* * * * *